US009188305B2

(12) United States Patent
Singh et al.

(10) Patent No.: US 9,188,305 B2
(45) Date of Patent: Nov. 17, 2015

(54) COOLING DEVICE FOR VEHICLE HEADLIGHTS

(71) Applicant: FUJIKURA, LTD., Koto-ku, Tokyo (JP)

(72) Inventors: Randeep Singh, Koto-ku (JP); Masataka Mochizuki, Koto-ku (JP)

(73) Assignee: FUJIKURA, LTD., Tokyo (JP)

( * ) Notice: Subject to any disclaimer, the term of this patent is extended or adjusted under 35 U.S.C. 154(b) by 0 days.

(21) Appl. No.: 14/506,787

(22) Filed: Oct. 6, 2014

(65) Prior Publication Data

US 2015/0098235 A1 Apr. 9, 2015

(30) Foreign Application Priority Data

Oct. 9, 2013 (JP) ..... 2013-211852

(51) Int. Cl.
*B60Q 1/04* (2006.01)
*F21S 8/10* (2006.01)

(52) U.S. Cl.
CPC ..... *F21S 48/325* (2013.01); *F21S 48/1159* (2013.01); *F21S 48/125* (2013.01); *F21S 48/13* (2013.01); *F21S 48/321* (2013.01); *F21S 48/326* (2013.01); *F21S 48/328* (2013.01)

(58) Field of Classification Search
CPC ..... F21V 29/006; F21V 29/004; F21V 29/40; F21V 29/763; F21V 23/005; F21V 29/71; F21V 29/74; F21V 29/2212; F21V 29/77; F21V 29/773; F21V 29/777; F21V 5/04; F21Y 2101/02; F21S 48/125; F21S 48/13; F21S 48/321; H01L 33/648
USPC ..... 362/101, 249.01, 249.02, 294, 373, 362/345, 507, 516, 538, 359, 544, 545, 547
See application file for complete search history.

(56) References Cited

U.S. PATENT DOCUMENTS 6,910,794 B2 * 6/2005 Rice ..... F21S 48/328 362/373
7,114,837 B2 * 10/2006 Yagi et al. ..... F21S 48/1159 362/249.04
7,201,506 B2 * 4/2007 Ishida et al. ..... F21S 48/1159 362/253
7,210,832 B2 * 5/2007 Huang ..... F21V 29/004 165/104.26
7,300,187 B2 * 11/2007 Huang et al. ..... F21V 29/004 362/294
7,344,289 B2 * 3/2008 Fallahi et al. ..... F21S 48/1159 362/294
7,543,960 B2 * 6/2009 Chang et al. ..... B82Y 10/00 362/294

(Continued)

FOREIGN PATENT DOCUMENTS

JP 2000-322908 A 11/2000
JP 2003-163479 A 6/2003

(Continued)

OTHER PUBLICATIONS

Office Action issued by Japanese Patent Office in Japanese Patent Application No. 2013-211852 mailed Nov. 5, 2013.

*Primary Examiner* — Hargobind S Sawhney
(74) *Attorney, Agent, or Firm* — Sughrue Mion, PLLC

(57) ABSTRACT

A cooling device for cooling an LED of vehicle headlight without restricting a design of a housing is provided. The cooling device is comprised of an LED held in a housing sealed with a lens, a reflector that reflects a light emitted from the light source, a heat collector on which the LED is mounted, a heat sink disposed behind the reflector, and a pair of heat pipes thermally connecting the heat collector and the heat sink. The heat sink is arranged inside of the housing.

8 Claims, 14 Drawing Sheets

(56) References Cited

U.S. PATENT DOCUMENTS

| | | | | |
|---|---|---|---|---|
| 7,762,696 | B2 * | 7/2010 | Wan et al. | B60Q 1/0017 362/294 |
| 7,771,088 | B2 * | 8/2010 | Chen | F21V 5/04 362/240 |
| 8,297,805 | B2 * | 10/2012 | Roucoules et al. | F21S 48/115 362/373 |
| 8,710,526 | B2 * | 4/2014 | Ramer et al. | H01L 31/024 165/104.19 |
| 2007/0127252 | A1 | 6/2007 | Fallahi et al. | |
| 2010/0067224 | A1 * | 3/2010 | Wu | F21K 9/00 362/235 |

FOREIGN PATENT DOCUMENTS

| | | | |
|---|---|---|---|
| JP | 2006-164967 | A | 6/2006 |
| JP | 2007-157729 | A | 6/2007 |
| JP | 2008-309453 | A | 12/2008 |
| JP | 2009-087620 | A | 4/2009 |
| JP | 2010-129543 | A | 6/2010 |
| JP | 2010-262903 | A | 11/2010 |
| JP | 2011-081937 | A | 4/2011 |
| JP | 2011-249057 | A | 12/2011 |
| JP | 3174401 | U | 3/2012 |
| JP | 2013-131316 | A | 7/2013 |
| JP | 2013-134855 | A | 7/2013 |

* cited by examiner

COOLING DEVICE FOR VEHICLE HEADLIGHTS

The present invention claims the benefit of Japanese Patent Application No. 2013-211852 filed on Oct. 9, 2013 with the Japanese Patent Office, the disclosure of which is incorporated herein by reference in its entirety.

BACKGROUND

1. Field of the Invention

The present invention relates to an art of a cooling device for vehicle headlights having a Light Emitting Diode (i.e., an LED).

2. Discussion of the Related Art

A cooling device for vehicle headlights having an LED illuminant is widely used in the conventional art. An electric consumption of the LED is advantageously low, but a calorific value of the LED is rather high and the LED is therefore easily to be heated. That is, since the LED is a semiconductor light source, an operating temperature limit of the LED is not sufficiently high and a usable temperature range thereof has to be limited. If the temperature of the LED exceeds the usable temperature range, durability and brightness thereof will be degraded. Therefore, in order to prevent an excessive temperature rise in the LED, a cooling device for the LED is used in the conventional vehicle headlights.

JP-A-2009-087620 describes a headlight for vehicle in which an exothermic LED is thermally connected to a heat sink as a heat dissipation member through a flexible heat-conductive member. In turn, JP-A-2006-164967 describes a vehicular lighting in which an LED is thermally connected to a heat sink through a loop heat pipe. According to the teachings of both JP-A-2009-087620 and JP-A-2006-164967, fins of the heat sink are exposed on the outside of a housing holding the LED.

Further, JP-A-2010-129543 describes a headlight for vehicle in which an LED is placed on an upper face of the heat sink fitted into a center hole formed in a housing. In addition, a cooling fan is disposed outside of the housing underneath the heat sink so that the heat sink can be cooled by the cooling fan through the center hole.

However, the fins of the heat sink thus exposed on the outside of the housing of the LED may enlarge the vehicle headlights taught by JP-A-2009-087620 and JP-A-2006-164967. In turn, the cooling fan thus integrated with the heat sink may also enlarge the vehicle headlights taught by JP-A-2010-129543.

In addition, according to any of the teachings of the foregoing prior art documents, the external shape of the housing may be restricted by the heat sink arranged on a part of a housing wall in the housing. Therefore, it is difficult to arrange an additional element in the housing of the headlight. That is, even if the headlight is required to be integrated with an additional cooling device, an external shape and a flexibility of arrangement of the additional cooling device may be restricted.

The present invention has been conceived nothing the foregoing technical problems, and it is therefore an object of the present invention is to provide a cooling device for vehicle headlights that effectively cools an LED as a light source while ensuring a flexibility of shape of a housing holding the LED.

SUMMARY OF THE INVENTION

The cooling device for vehicle headlights of the present invention is comprised of: an LED light source held in a housing sealed with a lens; a reflector that reflects a light emitted from the LED light source; a heat sink that is disposed behind the reflector; and a heat pipe that transports heat generated by the LED light source to the heat sink by a working fluid encapsulated therein. In order to achieve the above-mentioned objective, the cooling device is further provided with a flat cuboid vapor chamber that serves as a heat collector on which the LED light source is mounted. Specifically, the heat sink is comprised of a base covering the reflector from behind and above while keeping a distance therebetween, and a plurality of fins erected vertically to extend from the base in the opposite side of the reflector. Here, a surface area of a lower section of the fin is smaller than that of an upper section. The heat pipe includes: a first heat pipe in which one of end portions is flattened to be contacted with a front long side of the vapor chamber, and the other end portion penetrates through the upper section of the fin while being contacted therewith; and a second heat pipe in which one of end portions is flattened to be contacted with a rear long side of the vapor chamber, and the other end portion penetrates through the upper section of the fin while being contacted therewith. In addition, in the housing, the reflector is isolated from the vapor chamber and the heat pipes.

Specifically, the vapor chamber is comprised of a sealed container, a working fluid held in the container, and a wick that performs a capillary action.

Optionally, a piezo fan may be used in the cooling device to cool the LED light source by sending air over the LED light source. In this case, the piezo fan is disposed at a site not to block an incident light to the reflector emitted from the LED light source.

In addition, each of the first and the second heat pipe may be provided with a branch contacted with an inner face of the housing. In this case, said one of the end portion serves as an evaporating portion, said other end portion serves as a condensing portion, and the branch serves as another condensing portion.

Thus, according to the present invention, the heat sink is held in the housing. Therefore, a flexibility of design of the heat sink and the housing will not be restricted.

As described, according to the present invention, the vapor chamber is used as the heat collector. Therefore, the heat generated by the LED light source can be drawn efficiently by the vapor chamber so that the cooling performance of the cooling device can be enhanced.

As also described, the piezo fan may be used to send air to the LED light source. In this case, specifically, the air is sent over the LED light source by a pivotal movement of the piezo fan caused by an inverse piezo electric effect. A flow rate of the airflow created by the piezo fan is faster than that created by an axial fan so that the LED light source can be cooled more efficiently. Since the piezo fan is situated at a site not to block the incident light to the reflector emitted from the LED light source, a brightness of the headlight will not be decreased.

According to the present invention, the fins are erected vertically while being juxtaposed in the width direction to form a fin array. The condensing portion of the first heat pipe penetrates through the upper section of the fin array, and the condensing portion of the second heat pipe penetrates through the lower section of the fin array. As described, according to the present invention, the area of the lower section of the fin is smaller than that of the upper section. Therefore, a chimney effect can be induced to allow the vapor phase working fluid to flow upwardly through the flow passages between the fins so that the LED light source can be cooled more efficiently.

BRIEF DESCRIPTION OF THE DRAWINGS

Features, aspects, and advantages of exemplary embodiments of the present invention will become better understood with reference to the following description and accompanying drawings, which should not limit the invention in any way.

DETAILED DESCRIPTION OF THE PREFERRED EMBODIMENT(S)

Figure 1:
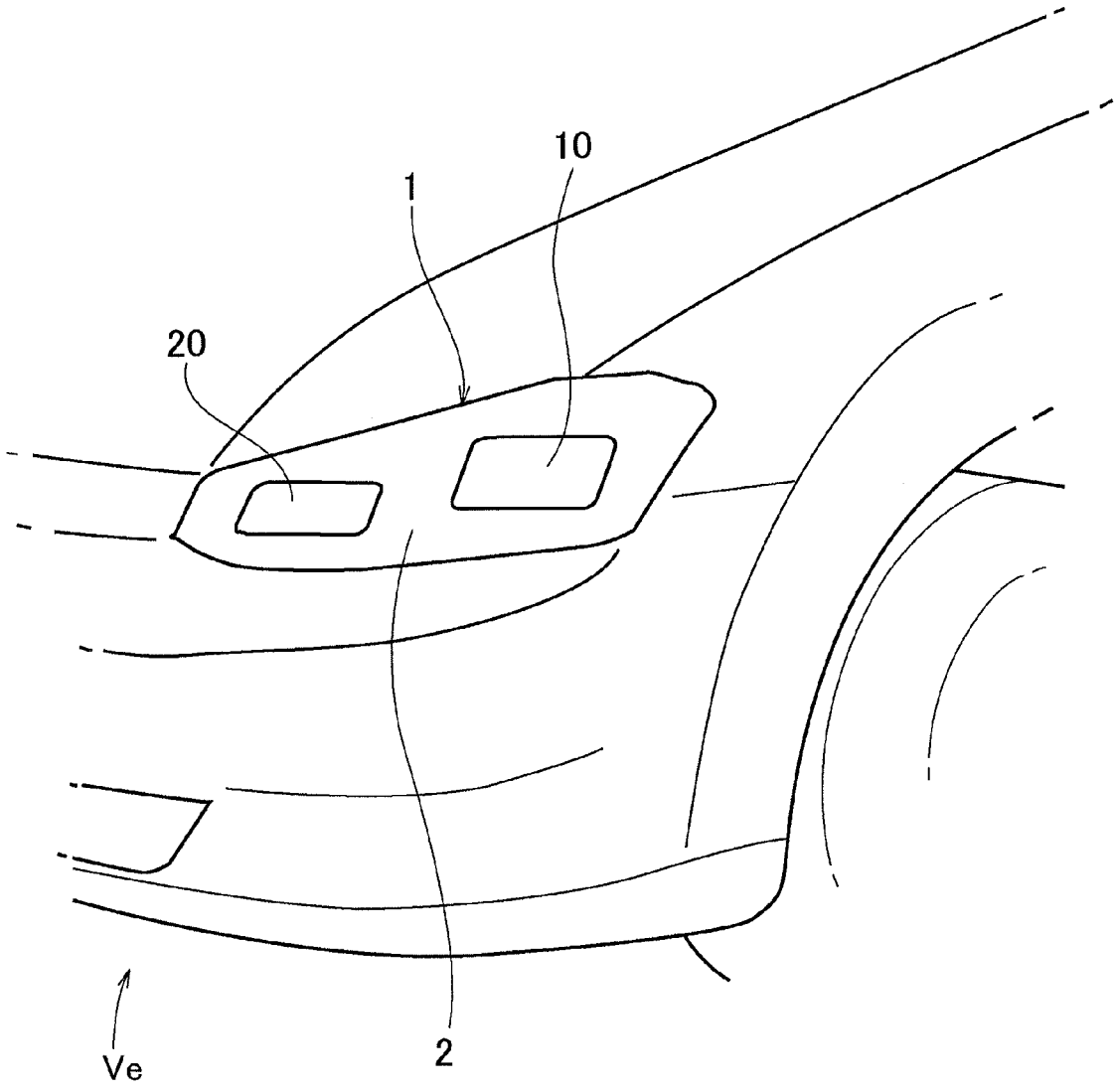
FIG. 1 is an illustration diagram schematically showing vehicle headlights to which the present invention is applied.

Hereinafter, the present invention will be explained in more details with reference to the accompanying drawings. An example of the vehicle headlights to which the present invention is applied is shown in FIG. 1. A headlight 1 is comprised of a lens 2 made of resin that is fitted into a front grille of a vehicle Ve, a first light 10 and a second light 20 whose brightness are different respectively. The lights emitted from the first light 10 and the second light 20 penetrate through the lens 2 as an outer lens to illuminate a road ahead.

In the headlight 1 shown in FIG. 1, the first light 10 is situated outside of the second light 20 in the width direction of the vehicle Ve. In both of the first light 10 and the second light 20, a light emitting device (to be abbreviated as the "LED" hereinafter) is individually employed as a light source. According to the example, the light emitted from the first light 10 is brighter than that emitted from the second light 20. Those first and second lights 10 and 20 can be turned on not only independently from each other but also simultaneously according to need.

Figure 2:
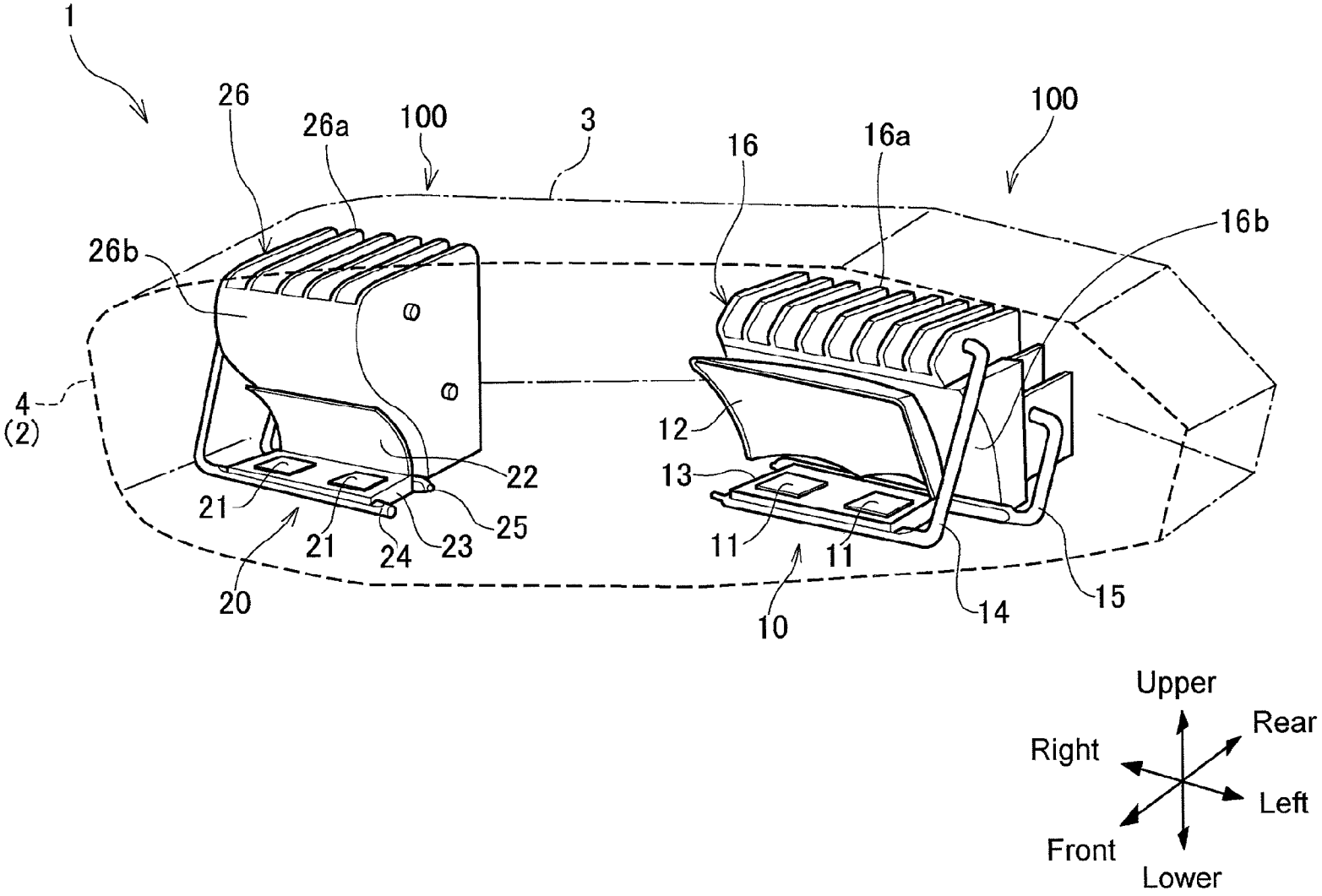
FIG. 2 is a perspective view schematically showing a cooling device for the vehicle headlights according to the first embodiment of the present invention.
Figure 3:
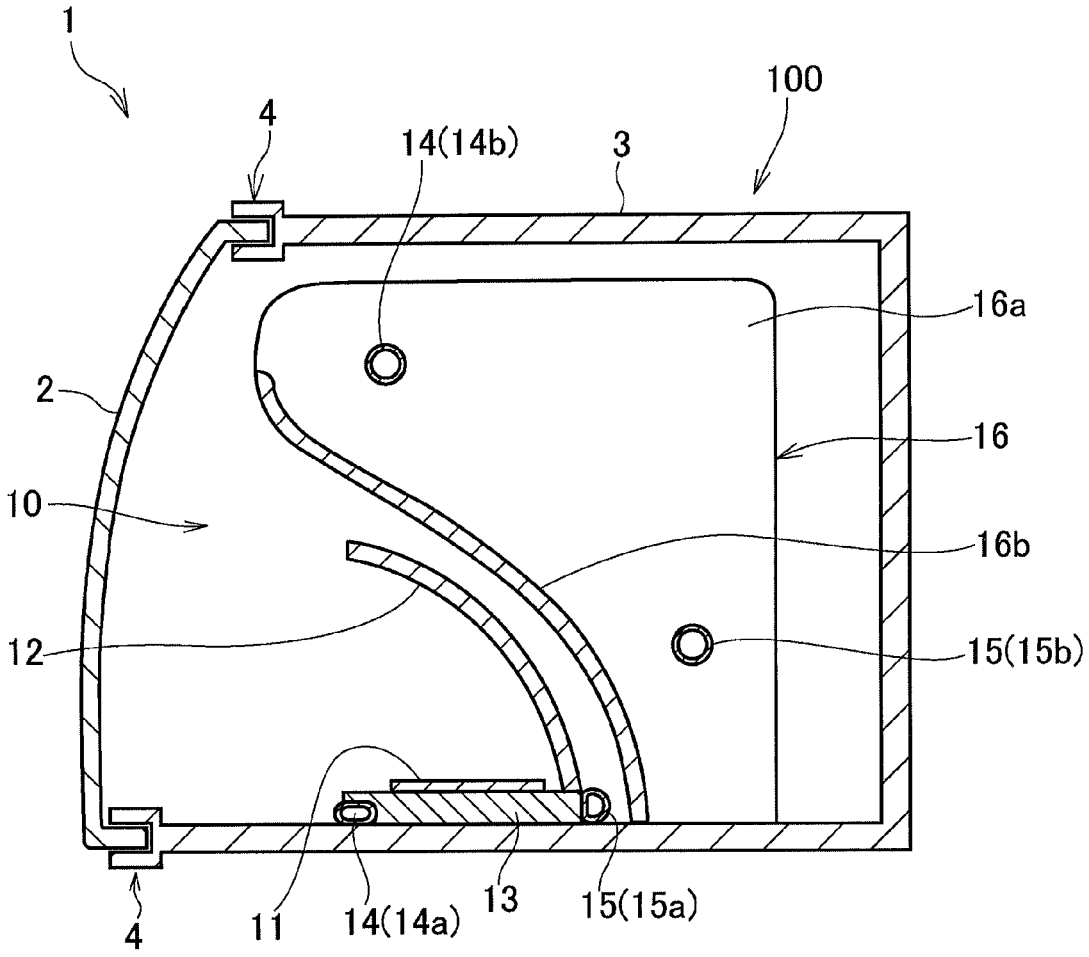
FIG. 3 is a cross-sectional view schematically showing the cooling device for a first light shown in FIG. 2.

Here will be explained the first embodiment of the headlight 1 with reference to FIGS. 2 and 3. FIG. 2 is a perspective view showing an inner structure of the headlight 1, and FIG. 3 is a cross-sectional view of the first light 10 of the headlight 1. As shown in FIG. 3 the first light 10 and the second light 20 are arranged in a housing 3, and a front opening of the housing 3 is closed by the lens 2. A sealing member 4 is arranged on an opening edge of the housing 3, and an outer edge of the lens 2 is fitted into the sealing member 4. Here, a configuration of the sealing member 4 should not be limited to the configuration shown in FIG. 3, and material of which should also not be limited to the specific material. According to the preferable embodiments of the present invention, resin material 4 is used to form the sealing member. Thus, the housing 3 serves as an outer casing of a unit of the headlight 1 to be fitted into a frame (not shown) of the vehicle Ve. In addition, a ventilation (not shown), e.g., a slit or the like is formed on a wall of the housing 3 so that a communication between an interior space of the housing 3 and an exterior is provided. Here, in FIG. 2, a dotted-dashed line indicates the housing 3, and a dashed line indicates the outer edge of the lens 2 or the sealing member 4.

According to the embodiment shown in FIG. 2, the first light 10 is provided with a pair of LEDs 11 juxtaposed in the width direction, and the second light 20 is provided with a pair of LEDs 21 juxtaposed in the width direction. For instance, a packaged light source in which an LED chip placed on a square board is connected to a not shown electronic circuit can be used as those LEDs 11 and 21. Therefore, the LEDs 11 and 21 are activated to emit light by applying a current to the electronic circuit. Accordingly, a definition of the term "LED" in the explanation is the plate like LED package comprising the LED chip and the board. In addition, in order not to expose the LED chip to air, the LED chip is covered with a resin mold.

In the housing 3, the LEDs 11 and 21 are laid horizontally to emit light upwardly. In order to reflect the light emitted by the LED 11 ahead of the vehicle Ve, the first light 10 is provided with a domed reflector 12 covering the first light 10 from behind and above. Likewise, in order to reflect the light emitted by the LED 21 ahead of the vehicle Ve, the second light 20 is also provided with a reflector 22 covering the second light 20 from behind and above. Here, configurations of the reflectors 12 and 22 may be not only identical to each other but also different from each other.

Next, a cooling device 100 arranged in the housing 3 will be explained hereinafter. The first light 10 and the second light 20 are individually provided with the cooling device 100 to cool the heat generating LEDs 11 and 21. The cooling device 100 for the first light 10 is adapted to collect the heat resulting from light emission of the LED 11 by a heat collector 13, and to radiate the heat from the heat sink 16 through a pair of heat pipes 14 and 15. Likewise, the cooling device 100 for the first light 20 is adapted to collect the heat resulting from light emission of the LED 21 by a heat collector 23, and to radiate the heat from the heat sink 26 through a pair of heat pipes 24 and 25. Since the heat sinks 16 and 26 are thus arranged inside of the housing 3, the heats generated by the LEDs 11 and 21 are radiated to the internal space of the housing 3.

In the cooling device 100 for the first light 10, the heat collector 13 is installed on the bottom of the housing 3, and the LED 11 is mounted on the heat collector 13. That is, a lower face of the board of the LED 11 and the upper face of the heat collector 13 are contacted tightly to each other so that the heat of the LED 11 can be transferred to the heat collector 13. In other words, the heat collector 13 is a flat cuboid heat conductive block made of material having high heat conductivity. Therefore, the heat generated by the LED 11 is transferred to the heat collector 13 homogeneously and entirely.

According to the preferred embodiment, the heat collector 13 is disposed longitudinally in a width direction of the vehicle Ve, and a pair of LEDs 11, 11 are juxtaposed in the width center of the heat collector 13. Accordingly, the heats of the LEDs 11 are drawn through the upper face of the heat collector 13 and spread radially downwardly in the heat collector 13.

Figure 4:
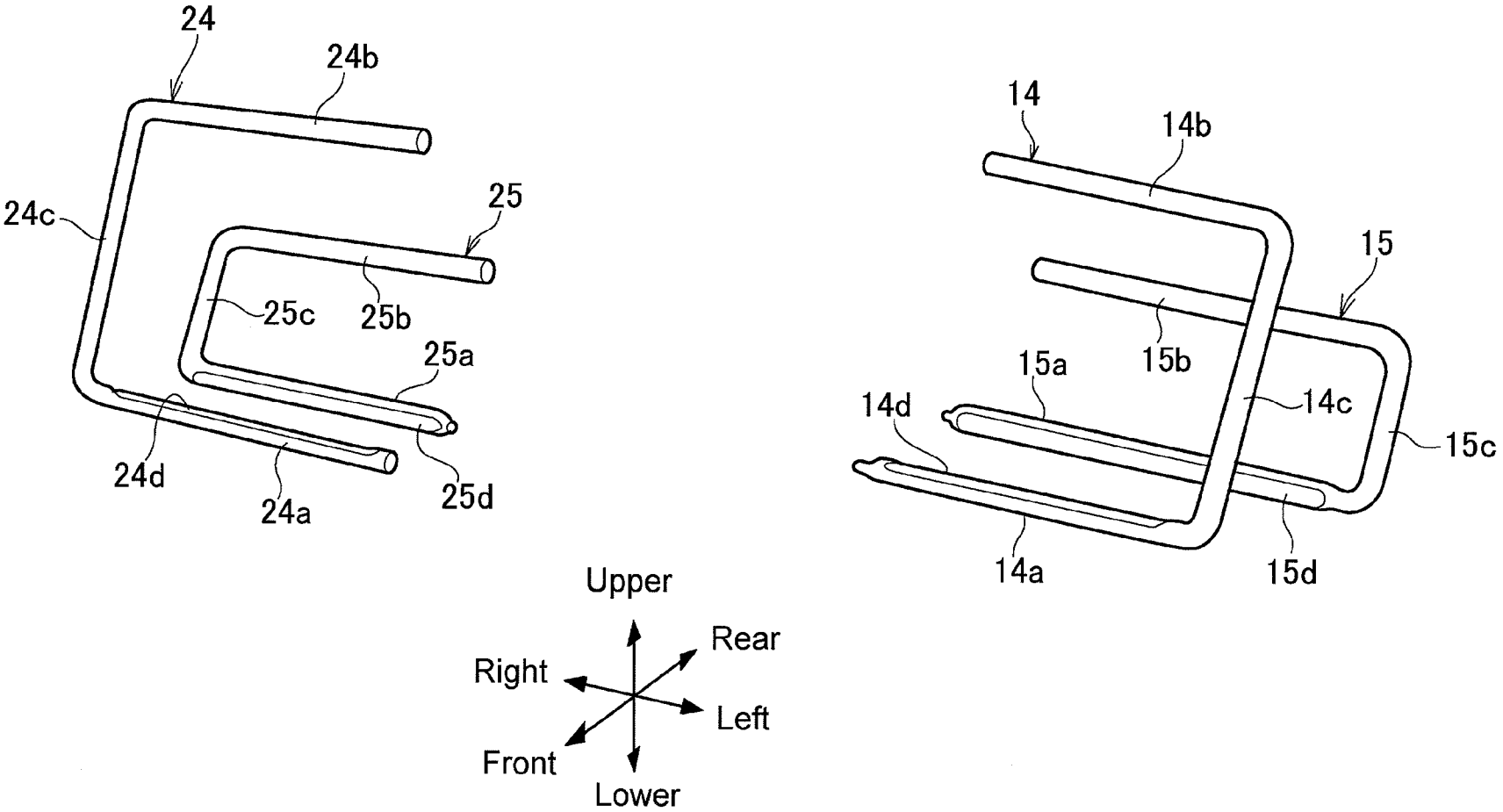
FIG. 4 is an illustration diagram showing the heat pipes used in the cooling device shown in FIG. 2.

The heat collector 13 is connected with the heat sink 16 though a pair of heat pipes 14 and 15 so that the heat of the heat collector 13 is transported to the heat sink 16 through the heat pipes 14 and 15. To this end, a conventional heat pipe in which working fluid encapsulated therein is individually employed as each heat pipes 14 and 15. In each heat pipe 14, 15, the working fluid is evaporated at a heated portion (i.e., at an evaporating portion) and condensed at a heat radiating portion (i.e., at a condensing portion). FIG. 4 shows a structure of each first heat pipe 14 and second heat pipe 15 of the cooling device 100 shown in FIG. 2.

As illustrated in FIG. 4, each first heat pipe 14 and second heat pipe 15 are shaped into U-shape. Specifically, the first heat pipe 14 is comprised of an evaporating portion 14*a*, a condensing portion 14*b* extending parallel to the evaporating portion 14*a*, and an insulating portion 14*c* connecting the evaporating portion 14*a* with the condensing portion 14*b*. Likewise, the second heat pipe 15 is comprised of an evaporating portion 15*a*, a condensing portion 15*b* extending parallel to the evaporating portion 15*a*, and an insulating portion 15*c* connecting the evaporating portion 15*a* with the condensing portion 15*b*. Here, the insulating portion 14*c* of the first heat pipe 14 is formed to be longer than the insulating portion 15*c* of the second heat pipe 15 thereby extending a heat transfer distance of the first heat pipe 14 to be longer than that of the second heat pipe 15. Optionally, the second heat pipe 15 may be formed to have a larger diameter than that of the first heat pipe 14.

In addition, the evaporating portion 14*a* is partially flattened to form a flat contact surface 14*d* and the evaporating portion 15*a* is partially flattened to form a flat surface 15*d*. Therefore, each contact area between the heat collector 13 and the flat contact surface 14*d* of the first heat pipe 14 and the flat contact surface 15*d* of the second heat pipe 15 are enlarged to enhance heat transfer efficiency therebetween.

Specifically, as shown in FIG. 3, the flat contact surface 14*d* of the evaporating portion 14*a* is contacted with a front long side of the heat collector 13, and the flat contact surface 15*d* of the evaporating portion 15*a* is contacted with a rear long side of the heat collector 13. Therefore, the heat is drawn from the LED 11 through the heat collector 13, and the working fluids in the evaporating portions 14*a* and 15*a* are evaporated by the heat of the heat collector 13. On the other hand, the condensing portion 14*b* of the first heat pipe 14 and the condensing portion 15*b* of the second heat pipe 15 individually penetrate through an array of fins 16.

As shown in FIG. 2, the heat sink 16 is disposed behind (i.e., in the back side) of the reflector 12. The heat sink 16 is comprised of a base 16*b* covering the reflector 12 from behind and above, and fins 16*a* erected vertically while being juxtaposed in the width direction to extend from the base 16*b* in the opposite side of the reflector 12. Accordingly, a plurality of flow passages for vertically letting through the air are formed between the fins 16*a*. An arrangement of the fin allay of the heat sink 16 is shown in FIG. 5.

Figure 5:
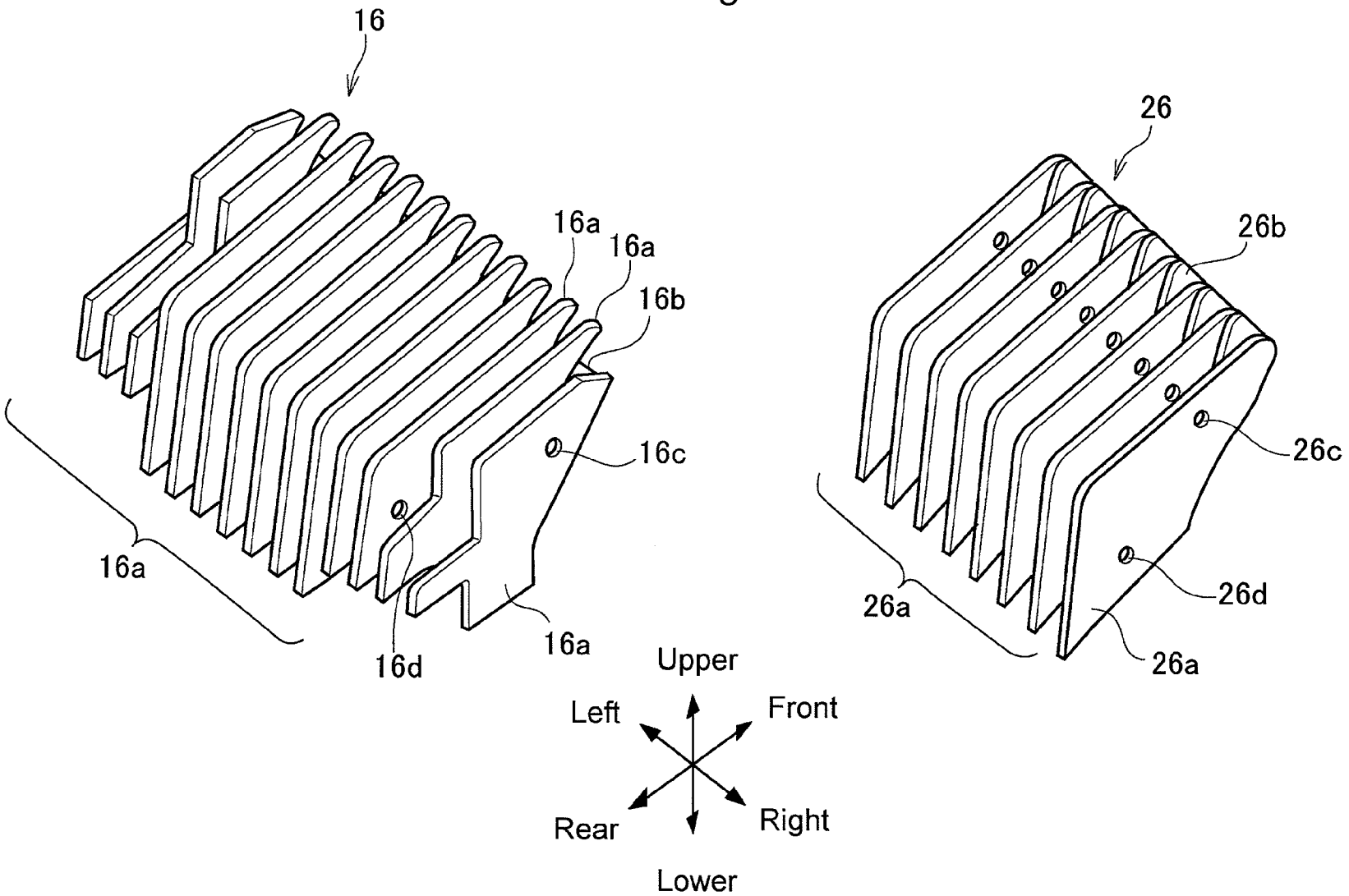
FIG. 5 is an illustration diagram showing a heat sink used in the cooling device shown in FIG. 2.

As shown in FIG. 5, a first through-hole 16*c* to which the first heat pipe 14 is inserted is formed on an upper section of each fin 16*a* of the heat sink 16, and a second through-hole 16*d* to which the second heat pipe 15 is inserted is formed on each fin 16*a* at a lower level than the first through-hole 16*c*. A surface area of the fin 16*a* above the first through-hole 16*c* is larger than that below the second through-hole 16*d*. That is, a heat capacity of the upper section of the fin 16*a* is larger than that of the lower section. In addition, both of the first through-hole 16*c* and the second through-hole 16*d* are formed at levels higher than the heat collector 13.

The first heat pipe 14 is inserted into each first through-hole 16*c* of the fin allay in a manner such that the condensing portion 14*b* is contacted with an inner circumference of the first through-hole 16*c*. Likewise, the second heat pipe 15 is inserted into each second through-hole 16*d* of the fin allay in a manner such that the condensing portion 15*b* is contacted with an inner circumference of the second through-hole 16*d*. Accordingly, the condensing portions 14*b* and 15*b* are situated above the evaporating portions 14*a* and 15*a*. Here, although the fins 16*a* are contacted to the bottom of the housing 3 in FIG. 3, the fins 16*a* may be isolated from the bottom of the housing 3.

In the first heat pipe 14, the working fluid is evaporated at the evaporating portion 14*a*, and the heat is transported to the condensing portion 14*b* by the vapor of the working fluid to be radiated from the fins 16*a*. Consequently, the working fluid in the vapor phase is condensed into the liquid phase at the condensing portion 14*b*. The working fluid thus condensed is returned to the evaporating portion 14*a* by a capillary force or gravity. Likewise, in the second heat pipe 15, the working fluid is evaporated at the evaporating portion 15*a*, and condensed into the liquid phase at the condensing portion 15*b* as a result of radiating the heat from the fins 16*a* and returned to the evaporating portion 15*a* by a capillary force or gravity. Thus, in the cooling device 100 for the first light 10, the LED 11 as a heat-generating member is connected to the heat sink 16 as a radiation device through the heat pipes 14 and 15 to transport the heat therebetween. That is, the heat generated by the LEDs 11 is radiated to the internal space of the housing 3.

In the cooling device 100 for the second light 20, the heat collector 23 is installed on the bottom of the housing 3, and the LED 21 is mounted on the heat collector 23. That is, a lower face of the board of the LED 21 and the upper face of the heat collector 23 are contacted tightly to each other so that the heat generated by the LED 21 can be conducted to the heat collector 23. In other words, the heat collector 23 is a flat rectangular heat conductive structure made of material having high heat conductivity. Therefore, the heat generated by the LED 21 is conducted to the heat collector 23 homogeneously and entirely.

According to the preferred embodiment, the heat collector 23 is disposed longitudinally in a width direction of the vehicle Ve, and a pair of LEDs 21, 21 are juxtaposed in the width center of the heat collector 23. Accordingly, the heats of the LEDs 21 are conducted to the width center of the upper face of the heat collector 23 and then the heat spread radially downwardly in the heat collector 23.

The heat collector 23 is connected with the heat sink 26 though a pair of heat pipes 24 and 25 so that the heat of the heat collector 23 is conducted to the heat pipes 24 and 25, and transported to the heat sink 26 through the heat pipes 24 and 25. To this end, a conventional heat pipe in which working fluid encapsulated therein is individually employed as each heat pipes 24 and 25. In each heat pipe 24, 25, the working fluid is evaporated at a heated portion (i.e., at an evaporating portion) and condensed at a heat radiating portion (i.e., at a condensing portion). FIG. 4 shows a structure of each first heat pipe 24 and second heat pipe 25 of the cooling device 100 shown in FIG. 2.

As illustrated in FIG. 4, each first heat pipe 24 and second heat pipe 25 are shaped into U-shape. Specifically, the first heat pipe 24 is comprised of an evaporating portion 24*a*, a condensing portion 24*b* extending parallel to the evaporating portion 24*a*, and an insulating portion 24*c* connecting the evaporating portion 24*a* with the condensing portion 24*b*. Likewise, the second heat pipe 25 is comprised of an evaporating portion 25*a*, a condensing portion 25*b* extending parallel to the evaporating portion 25*a*, and an insulating portion 25*c* connecting the evaporating portion 25*a* with the condensing portion 25*b*. Here, the insulating portion 24*c* of the first heat pipe 24 is formed to be longer than the insulating portion 25*c* of the second heat pipe 25 thereby extending a heat transfer distance of the first heat pipe 24 to be longer than that of the second heat pipe 25. Optionally, the second heat pipe 25 may be formed to have a larger diameter than that of the first heat pipe 24.

In addition, an outer surface of the evaporating portion 24*a* is partially flattened to form a flat surface 24*d* contacted with a front long side of the heat collector 23. Likewise, an outer surface of the evaporating portion 25*a* is partially flattened to form a flat surface 25*d* contacted with a rear long side of the heat collector 23. Therefore, each contact area between the heat collector 23 and each heat pipe 24, 25 can be enlarged to enhance heat transfer efficiency. Thus, the evaporating portion 24*a* of the first heat pipe 24 and the evaporating portion 25*a* of the second heat pipe 25 extend parallel to each other in the width direction across the heat collector 23.

The heat generated by the LED 21 is conducted individually to the evaporating portions 24*a* and 25*a* at the front and rear long sides of the heat collector 23, and the working fluids held therein are evaporated by the heat from the LED 21. On the other hand, the condensing portion 24*b* of the first heat pipe 24 and the condensing portion 25*b* of the second heat pipe 25 individually penetrate through an array of fins 26.

As shown in FIG. 2, the heat sink 26 is disposed behind (i.e., in the back side) of the reflector 22. The heat sink 26 is comprised of a base 26*b* covering the reflector 22 from behind and above, and fins 26*a* erected vertically while being juxtaposed in the width direction to extend from the base 26*b* in the opposite side of the reflector 22. Accordingly, a plurality of flow passages for vertically letting through the air are formed between the fins 26*a*. An arrangement of the fin allay of the heat sink 26 is shown in FIG. 5.

As shown in FIG. 5, a first through-hole 26*c* to which the first heat pipe 24 is inserted is formed on an upper section of each fin 26*a* of the heat sink 26, and a second through-hole 26*d* to which the second heat pipe 25 is inserted is formed on each fin 26*a* at a lower level than the first through-hole 26*c*. A surface area of the fin 26*a* above the first through-hole 26*c* is larger than that below the second through-hole 26*d*. That is, a heat capacity of the upper section of the fin 26*a* is larger than that of the lower section. In addition, both of the first through-hole 26*c* and the second through-hole 26*d* are formed at levels higher than the heat collector 23. Here, the heat sink 16 for the first light 10 may be formed in the shape of the heat sink 26 for the second light 20. Alternatively, the heat sink 16 may be either the same as or different size from the heat sink 26. For example, the heat sink 16 may be larger than the heat sink 26.

The first heat pipe 24 is inserted into each first through-hole 26*c* of the fin allay in a manner such that the condensing portion 24*b* is contacted with an inner circumference of the first through-hole 26*c*. Likewise, the second heat pipe 15 is inserted into each second through-hole 26*d* of the fin allay in a manner such that the condensing portion 25*b* is contacted with an inner circumference of the second through-hole 26*d*. Accordingly, the condensing portions 24*b* and 25*b* are situated above the evaporating portions 24*a* and 25*a*. Here, although the fins 26*a* are contacted to the bottom of the housing 3, the fins 26*a* may be isolated from the bottom of the housing 3.

In the first heat pipe 24, the working fluid is evaporated at the evaporating portion 24*a*, and the heat is transported to the condensing portion 24*b* by the vapor of the working fluid to be radiated from the fins 26*a*. Consequently, the working fluid in the vapor phase is condensed into the liquid phase at the condensing portion 24*b*. The working fluid thus condensed is returned to the evaporating portion 24*a* by a capillary force or gravity. Likewise, in the second heat pipe 25, the working fluid is evaporated at the evaporating portion 25*a*, and condensed into the liquid phase at the condensing portion 25*b* as a result of radiating the heat from the fins 26*a* and returned to the evaporating portion 25*a* by a capillary force or gravity. Thus, in the cooling device 100 for the second light 20, the LED 21 as a heat-generating member is connected to the heat sink 26 as a radiation device through the heat pipes 24 and 25 to transport the heat therebetween. That is, the heat generated by the LEDs 21 is radiated to the internal space of the housing 3.

As described, according to the first embodiment of the cooling device for the headlights, the heat sink serving as the heat radiating member is arranged in the housing of the headlights so that the LEDs can be cooled efficiently without blocking lights from the LEDs. In addition, a flexibility of design of the heat sink and the housing will not be restricted. As also described, the condensing portion of each heat pipe individually penetrate through the upper section and the lower section of the fins while being contacted therewith, and the area of the lower section of the fin is smaller than that of the upper section. Therefore, a chimney effect can be induced to allow the vapor phase working fluid to flow upwardly through the flow passages between the fins. Consequently, the heat of the LEDs can be efficiently radiated from the heat sink so that cooling capacity for LEDs can be enhanced. In addition, since the area of the lower section of the fin is thus smaller than that of the upper section, the heat capacity of the lower section of the fins is smaller than that of the upper section. That is, the temperature of the lower section of the fin is raised faster than that of the upper section. Therefore, the upward stream of the working fluid can be further expedited so that the heat of the LEDs can be radiated from the fins efficiently.

The cooling device for vehicle headlights should not be limited to the first embodiment, and may be modified within the spirit of the present invention.

Figure 6:
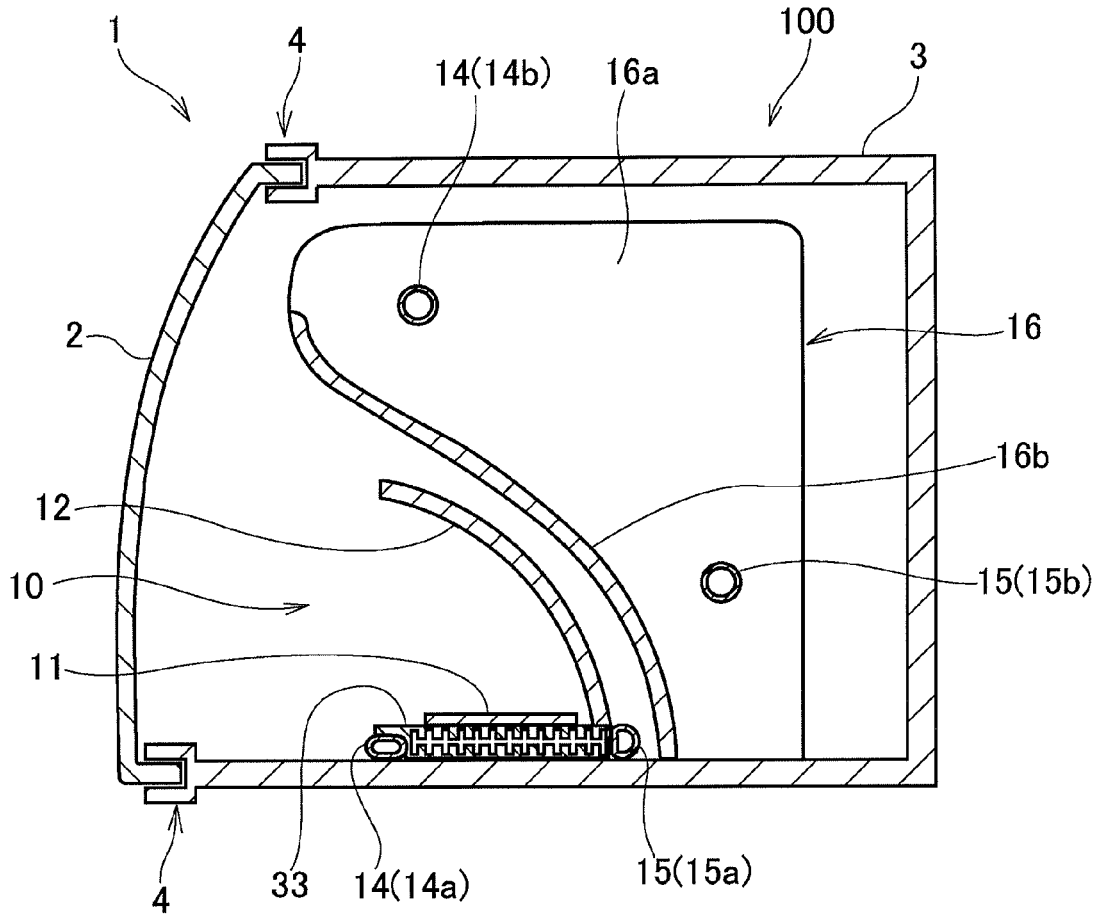
FIG. 6 is a cross-sectional view schematically showing the cooling device for the vehicle headlights according to the second embodiment of the present invention.

For example, according to the second embodiment of the present invention, a vapor chamber (i.e., a flat heat pipe) is employed as at least any one of the heat collector 13 of the first light 10 and the heat collector 23 of the second light 20 instead of the heat conductive block. Referring now to FIG. 6, there is shown an example in which the vapor chamber is used as the heat collector in the first light 10. Here, in the following explanation of the second embodiment, common reference numerals are allotted to the elements identical to those in the first embodiment, and detailed explanation for those elements will be omitted.

As shown in FIG. 6, according to the second embodiment, a vapor chamber 33 is laid on the bottom of the housing 3, and the LED 11 is disposed on the upper face of the vapor chamber 33. The front face of the vapor chamber 33 is contacted with the evaporating portion 14*a* of the heat pipe 14, and the rear face of the vapor chamber 33 is contacted with the evaporating portion 15*a* of the heat pipe 15. As the conventional vapor chamber, a small amount of the working fluid is encapsulated in a sealed internal space of the vapor chamber 33, and a wick is disposed therein. According to the second embodiment, therefore, the heat of the LED 11 can be transported efficiently to the heat sink 16 utilizing the heat transportation property of the vapor chamber 33 so that the cooling performance of the cooling device 100 can be enhanced.

Figure 7:
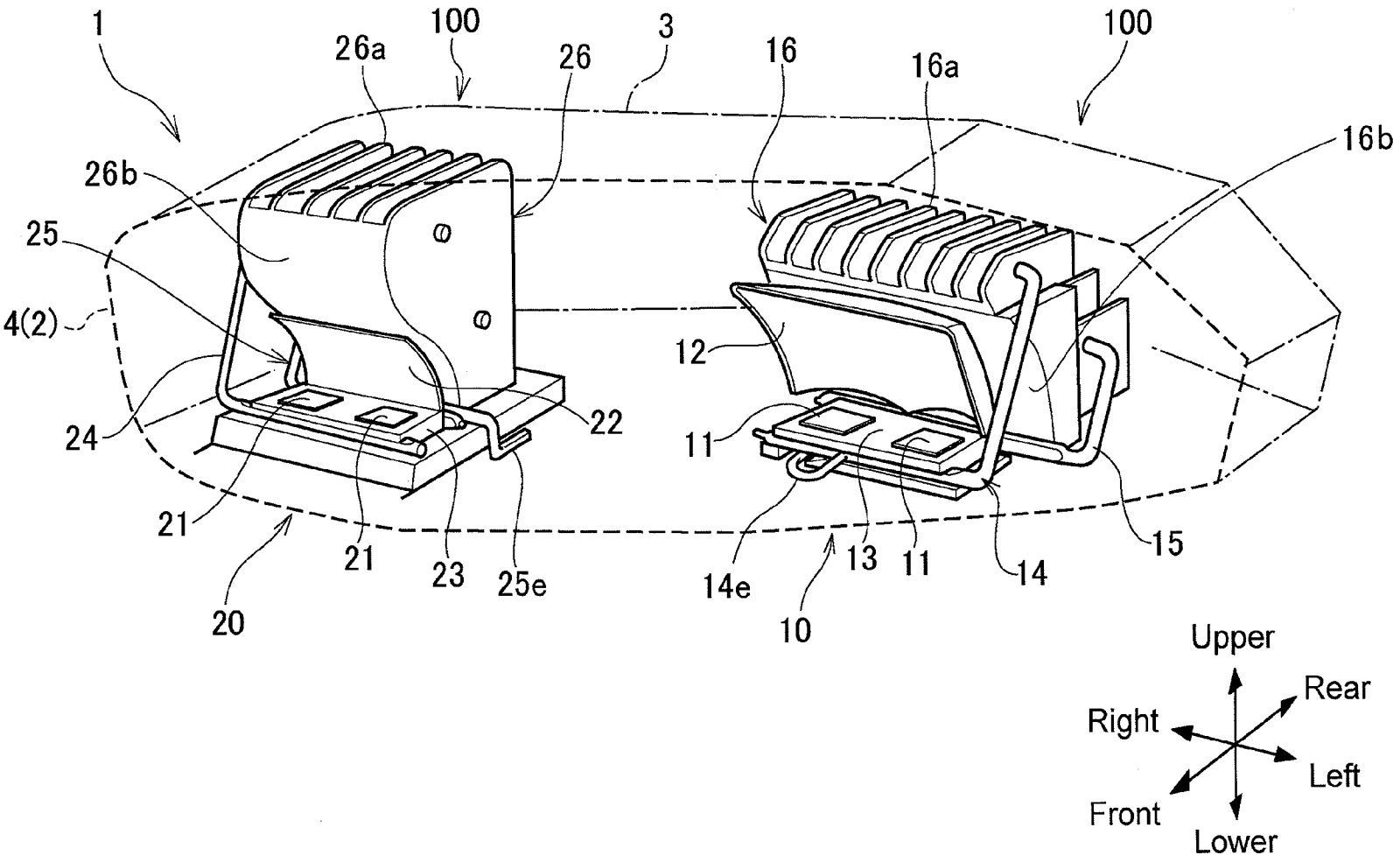
FIG. 7 is a perspective view showing the cooling device for the vehicle headlights according to the third embodiment of the present invention.

According to the third embodiment of the cooling device, as shown in FIG. 7, the first heat pipe 14 is modified to contact the condensing portion thereof with the housing 3. In the following explanation of the third embodiment, common reference numerals are also allotted to the elements identical to those in the foregoing embodiments, and detailed explanation for those elements will also be omitted.

As illustrated in FIG. 7, in the first light 10, a second condensing portion 14*e* is extended from the first heat pipe 14 to be contacted with the bottom of the housing 3. Also, in the second light 20, a second condensing portion 25*e* is extended from the second heat pipe 25 to be contacted with the bottom of the housing 3. Details of structures of heat pipes 14, 15, 24, and 25 of the third embodiment are shown in FIG. 8.

Figure 8:
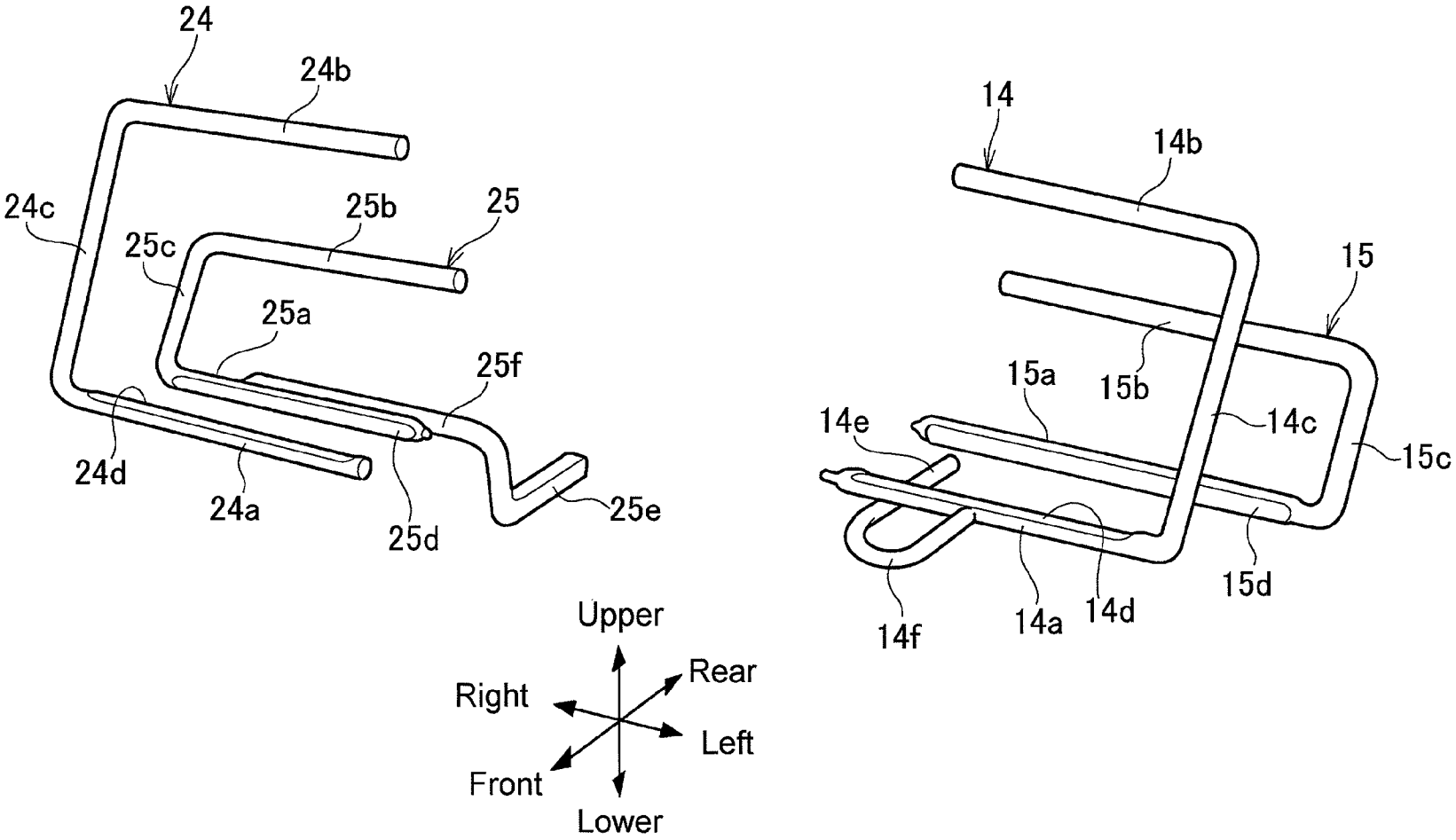
FIG. 8 is an illustration diagram showing the heat pipes used in the cooling device shown in FIG. 7.

As shown in FIG. 8, in the first heat pipe 14 of the first light 10, a branch is extended from an intermediate portion of the evaporating portion 14*a* contacted with the heat collector 13 to protrude in the forward direction, and bent downwardly backwardly at a predetermined portion to form a U-shaped branch. In the U-shaped branch, specifically, a portion between the evaporating portion 14*a* and the bent portion serves as a second insulting portion 14*f*, and a portion extending further than the bent portion is contacted with the housing 3 to serve as the second condensing portion 14*e*. Thus, the evaporating portion 14*a* is connected to the first condensing portion 14*b* via the first insulating portion 14*c*, and also connected to the second condensing portion 14*e* via the second insulating portion 14*f*.

In turn, in the second heat pipe 25 of the second light 20, a branch is extended in parallel with the evaporation portion 25*a* contacted with the heat collector 23 from an intermediate portion, and a leading end of the branch is bent downwardly and further bent backwardly to form an L-shaped leading end. In the branch, specifically, a portion extending along the evaporating portion 25*a* serves as a second insulting portion 25*f*, and a portion of the L-shaped leading end extending backwardly along the bottom of the housing 3 serve as the second condensing portion 25*e*. Thus, the evaporating portion 25*a* is connected to the first condensing portion 25*b* via the first insulating portion 25*c*, and also connected to the second condensing portion 25*e* via the second insulating portion 25*f*.

Figure 9:
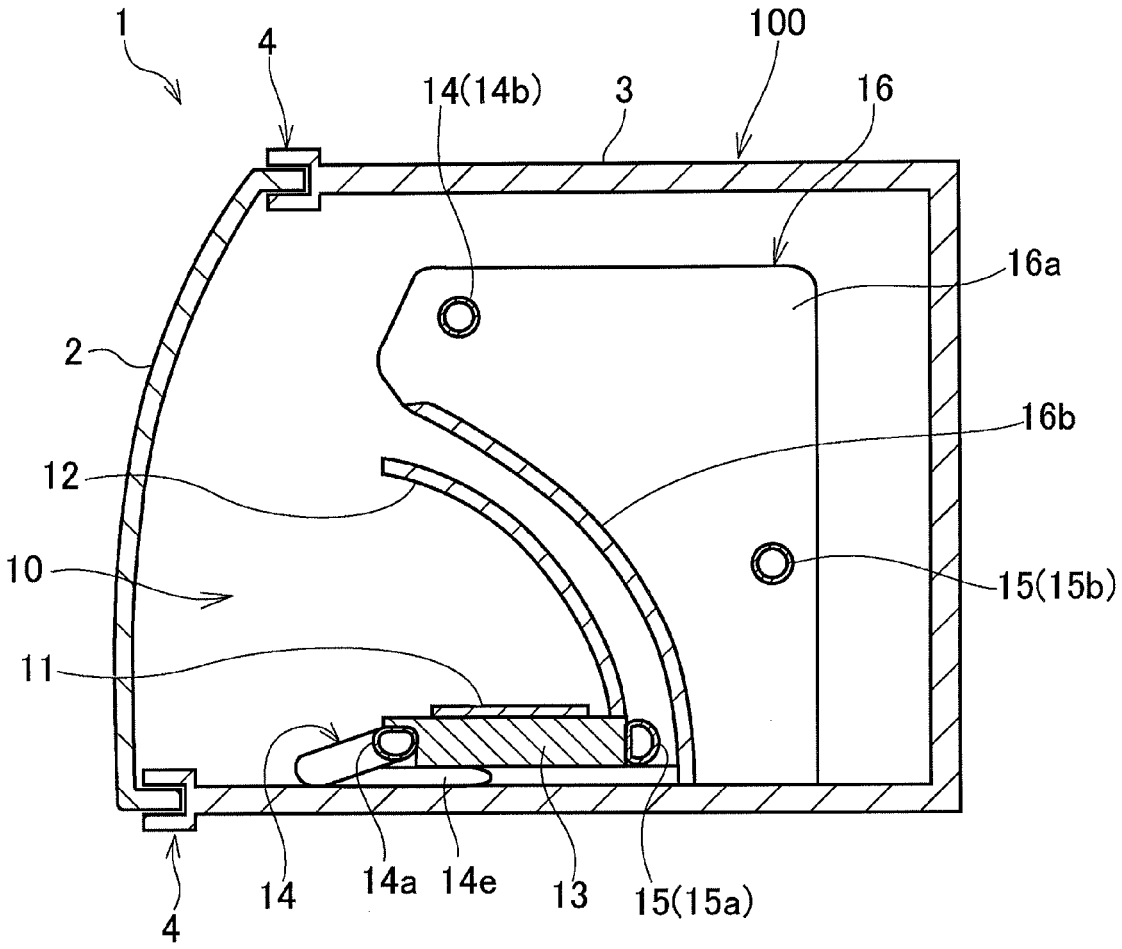
FIG. 9 is a cross-sectional view schematically showing the cooling device for the first light shown in FIG. 7.
Figure 10:
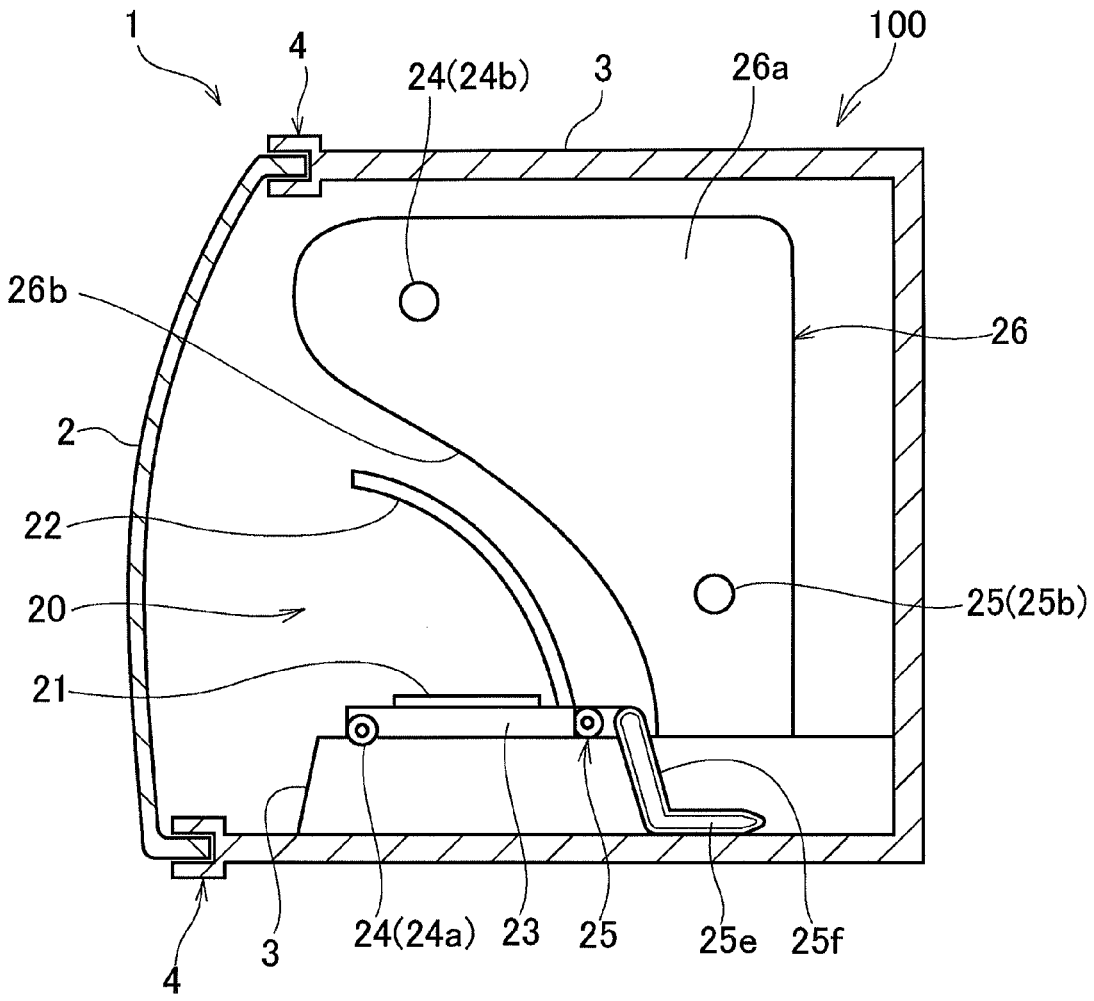
FIG. 10 is a cross-sectional view schematically showing the cooling device for the second light shown in FIG. 7.

As shown in FIG. 9, in the first heat pipe 14, the first condensing portion 14*b* penetrates through an array of fins 16*a* while being contacted thereto, and the second condensing portion 14*e* is contacted with the bottom of the housing 3. As also shown in FIG. 10, in the second heat pipe 25, the first condensing portion 25*b* penetrates through an array of fins 26*a* while being contacted thereto, and the second condensing portion 25*e* is contacted with the bottom of the housing 3. Thus, both of the first heat pipe 14 and the second heat pipe 15 conduct the heats to different objects.

Thus, according to the third embodiment of the cooling device for the headlights, each heat pipe is individually provided with the branch functioning as the second condensing portion contacted with the housing. Accordingly, the heat radiating capacity of each condensing portion can be increased so that the heat transporting capacity of each first and second heat pipe can be enhanced to cool the LEDs effectively.

The structure of each branch may be modified arbitrarily in a manner such that the second condensing portion of the first heat pipe is contacted with the housing, and that the second condensing portion of the second heat pipe is contacted with the housing.

Figure 11:
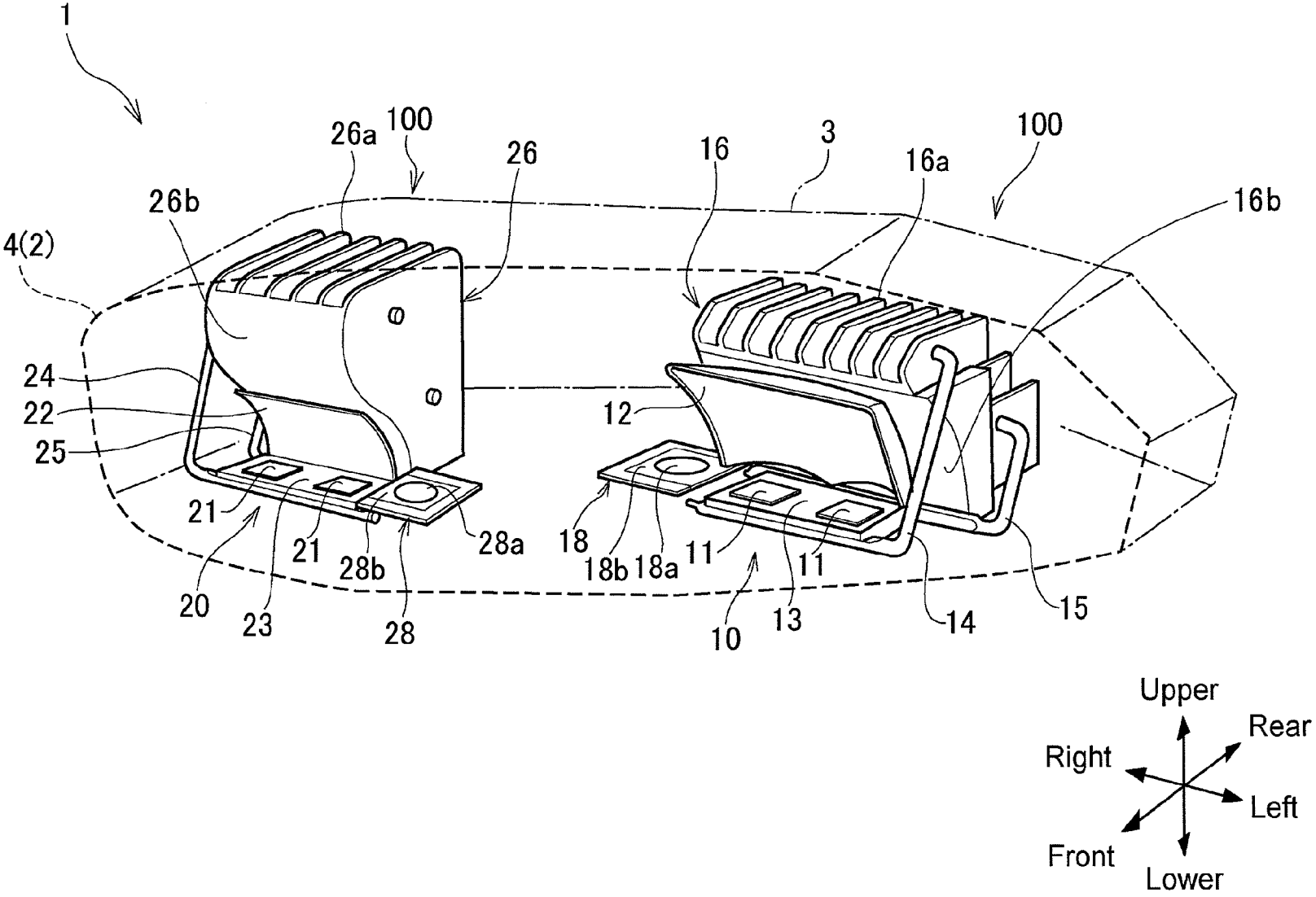
FIG. 11 is a perspective view schematically showing the cooling device for the vehicle headlights according to the fourth embodiment of the present invention.

According to the fourth embodiment, as shown in FIG. 11, the cooling device is provided with a fan for cooling the LEDs by blowing air. In the following explanation of the fourth embodiment, common reference numerals are also allotted to the elements identical to those in the foregoing embodiments, and detailed explanation for those elements will also be omitted.

As illustrated in FIG. 11, the first light 10 is provided with a piezo fan 18 for sending air to the LED 11, and the second light 20 is provided with a piezo fan 28 for sending air to the LED 21. Each piezo fan 18, 28 is individually provided with a plate-like pivotal fan 18*b*, 28*b* individually having a piezoelectric element 18*a*, 28*a*. Accordingly, a pivotal movement of each pivotal fan 18*b*, 28*b* is achieved by energizing the piezoelectric element 18*a*, 28*a* to cause an inverse piezoelectric effect thereby sending airflow to the surface of the LED 11, 21. To this end, each piezo fan 18, 28 is individually connected to an electronic circuit (not shown).

Figure 12:
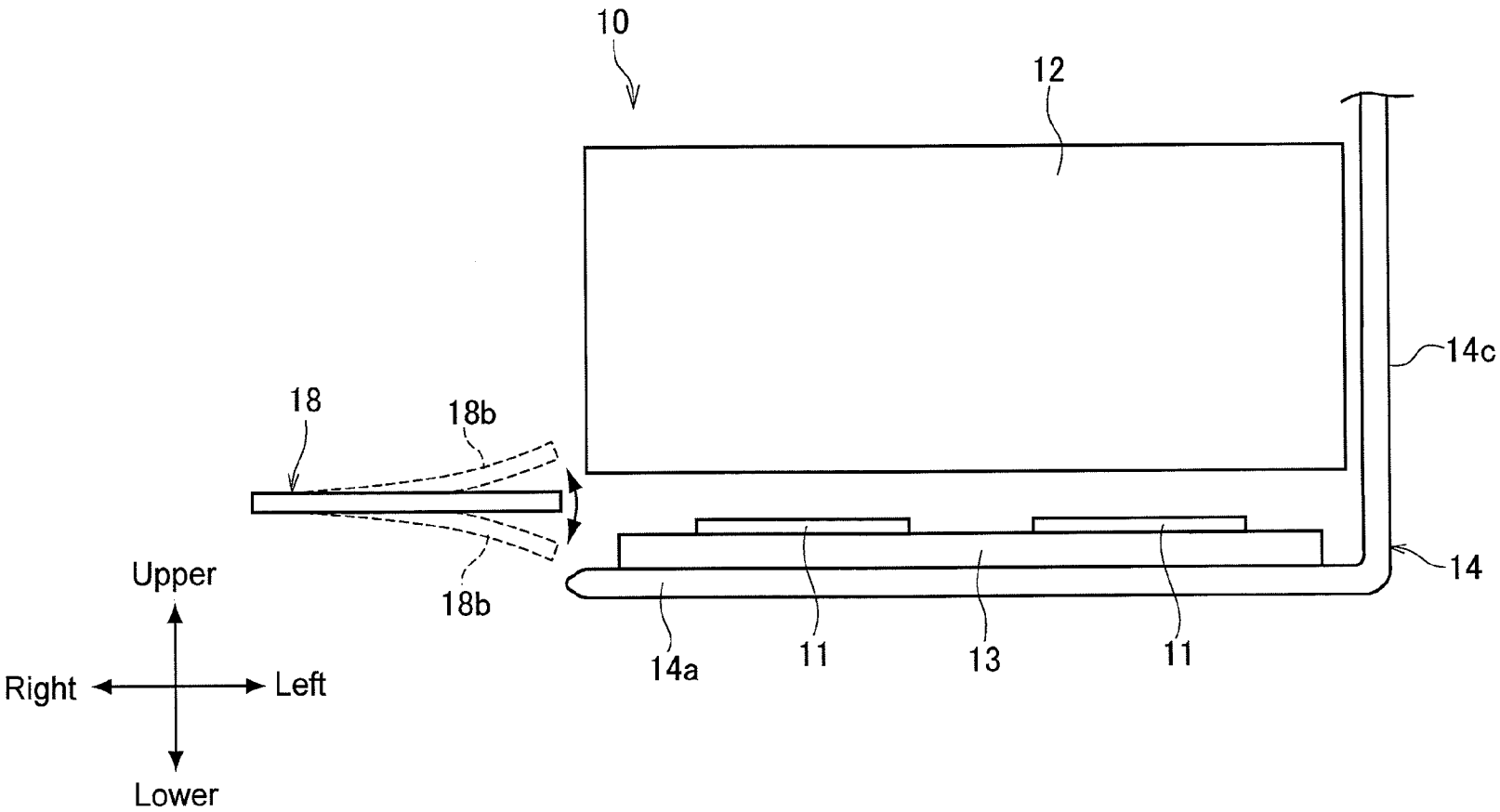
FIG. 12 is a front view showing a motion and an arrangement of a piezo fan for the first light shown in the FIG. 11.

The piezo fan 18 is arranged in a manner not to block the incident light to the reflector 12 emitted from the LED 11 As shown in FIG. 12, the piezo fan 18 is disposed inside of the collector 13 in the width direction at a vertically higher level than the LED 11. As described, the vertical pivotal movement of the pivotal fan 18*b* is achieved by energizing the piezoelectric element 18*a* to cause an inverse piezoelectric effect. That is, the piezo fan 18 is disposed on the opposite side of the insulating portions 14*c* and 15*c* of the heat pipes 14 and 15.

Specifically, the piezo fan 18 is disposed at a site not to intervene in the reflection of the light of the LED 11 by the reflector 12. In other words, the piezo fan 18 is arranged out of a reflection range of the reflector 12 in order not to block the light illuminating the road ahead of the vehicle.

Likewise, the piezo fan 28 is arranged in a manner not to block the incident light of the second light 20 illuminating road ahead. The piezo fan 28 is disposed outside of the collector 23 in the width direction at a vertically higher level than the LED 21. The vertical pivotal movement of the pivotal fan 28*b* is also achieved by energizing the piezoelectric element 28*a* to cause an inverse piezoelectric effect. That is, the piezo fan 28 is disposed on the opposite side of the insulating portions 24*c* and 25*c* of the heat pipes 24 and 25.

Thus, according to the fourth embodiment of the cooling device for the headlights, the LED can be cooled by sending the air from the piezo fans over the surface of the LED. In addition, a flow rate of the airflow created by the piezo fan is faster than that created by an axial fan so that the LED can be cooled more efficiently.

The location of each piezo fan should not be limited to the above-explained site. For example, the piezo fan may also be disposed on the opposite side of the heat collector where the insulating portion of the heat pipe extends. Alternatively, the piezo fan may also be situated above the reflector to send air vertically to the LEDs.

Figure 13:
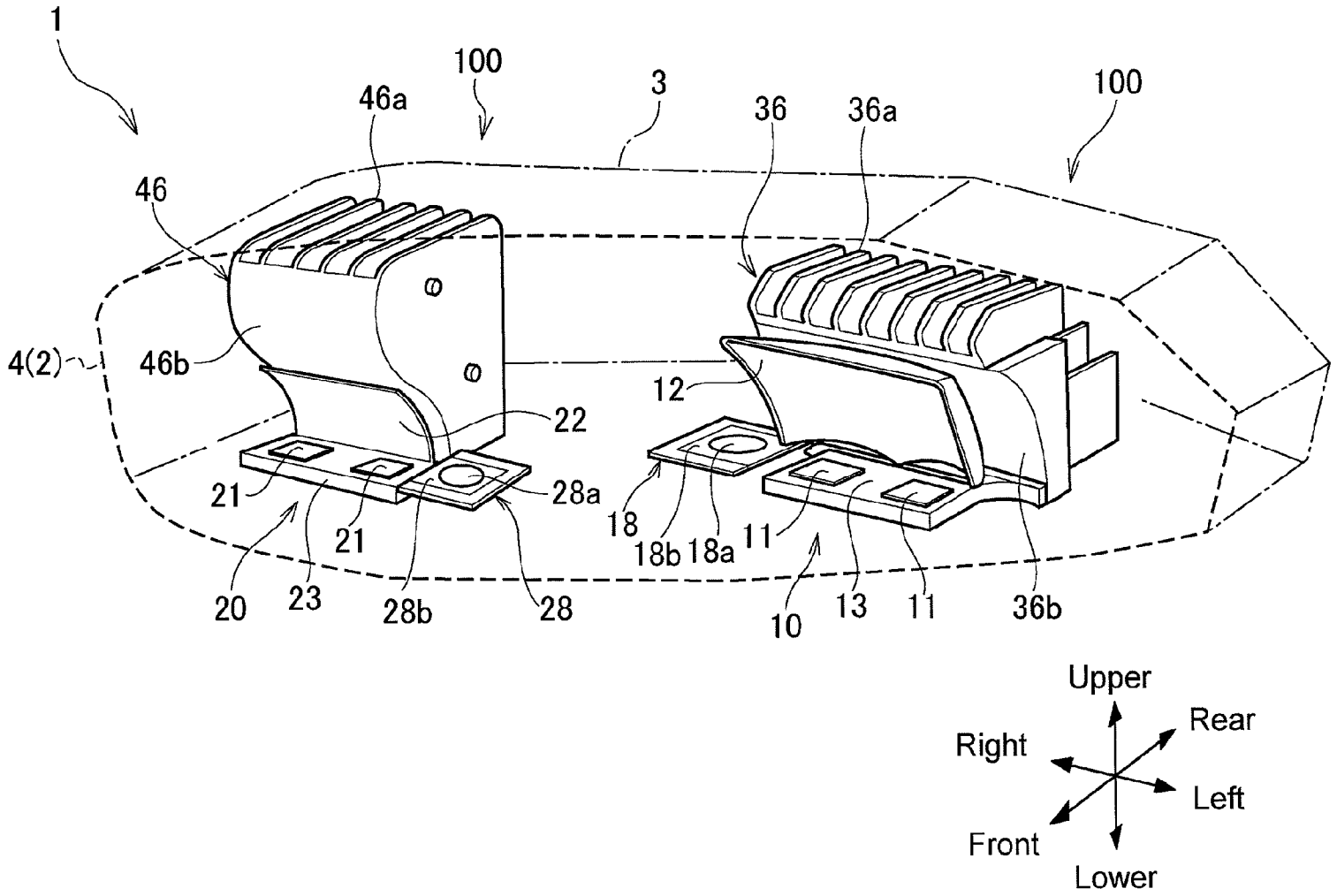
FIG. 13 is a perspective view schematically showing the cooling device for the vehicle headlights according to the fifth embodiment of the present invention.
Figure 14:
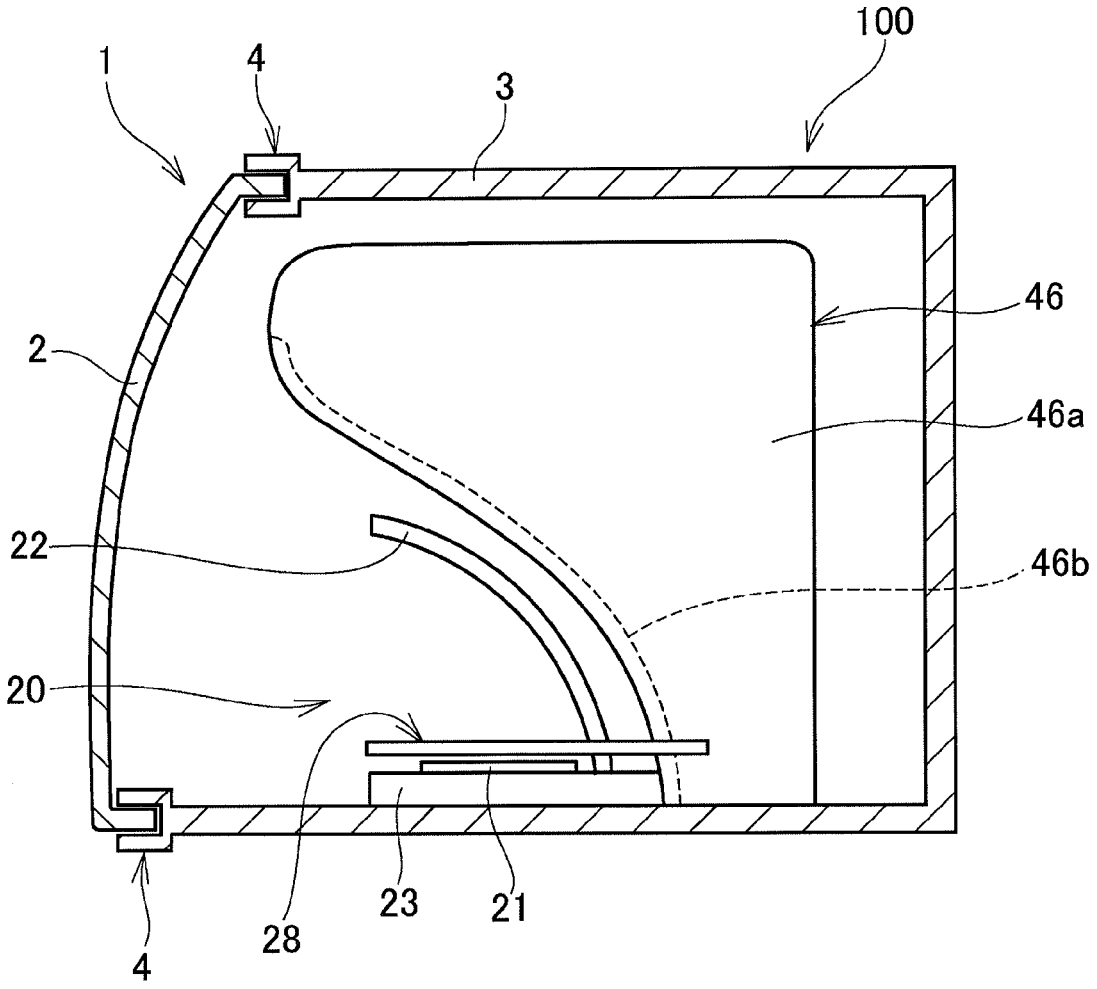
FIG. 14 is a cross-sectional view schematically showing the cooling device for a second light shown in FIG. 2.

According to the fifth embodiment of the present invention, as shown in FIG. 13, the cooling device is adapted to transport the heat of the LED to the heat sink without using the heat pipe. In the following explanation of the fifth embodiment, common reference numerals are also allotted to the elements identical to those in the foregoing embodiments, and detailed explanation for those elements will also be omitted.

According to the fifth embodiment, heat sinks 36 and 46 individually made of high heat conductive aluminum alloy (e.g. DMS-1) are employed instead of the above explained heat sinks 16 and 26. Specifically, the heat sink 36 of the first light 10 is comprised of a plurality of fins 36*a*, and the heat sink 46 of the second light 20 is comprised of a plurality of fins 46*a*.

As shown in FIG. 13, the heat sink 36 is disposed behind the reflector 12. The heat sink 36 is comprised of a base 36*b* covering the reflector 12 from behind, and fins 36*a* erected vertically while being juxtaposed in the width direction to extend from the base 36*b* in the opposite side of the reflector 12. Accordingly, a plurality of flow passages for vertically letting through the air are formed between the fins 36*a*. According to the fifth embodiment, the heat collector 13 is attached to the lower portion of the base 36*b* to protrude horizontally ahead of the base 36*b*. Optionally, the heat collector 13 may also be formed of DMS-1. The LEDs 11 are disposed on the heat collector 13 so that the heats of the LEDs 11 are transported to the fin 36*a* through the base 36*b*.

In turn, the heat sink 46 is disposed behind the reflector 12. The heat sink 46 is comprised of a base 46*b* covering the reflector 12 from behind, and fins 46*a* erected vertically while being juxtaposed in the width direction to extend from the base 46*b* in the opposite side of the reflector 12. Accordingly, a plurality of flow passages for vertically letting through the air are formed between the fins 46*a*. According to the fifth embodiment, the heat collector 23 is attached to the lower portion of the base 46*b* to protrude horizontally ahead of the base 46*b*. As described, the heat collector 23 may also be formed of DMS-1. The LEDs 21 are also disposed on the heat collector 23 so that the heats of the LEDs 21 are transported to the fin 46*a* through the base 46*b*.

The piezo fan 18 of the first light 10 may be disposed on any of lateral sides of the heat collector 13. Likewise, the piezo fan 28 of the second light 20 may also be disposed on any of lateral sides of the heat collector 23. Specifically, as shown in FIG. 13, the piezo fan 18 is arranged on the inner side of the heat collector 13 in the width direction, and the piezo fan 28 is arranged on the outer side of the heat collector 23 in the width direction.

According to the fifth embodiment, since the heat sinks 36 and 46 are made of DMS-1, the heat conductivity of the heat sinks can be enhanced so that the LEDs can be cooled more effectively. In addition, since the heat pipes are not used in this embodiment, a required space of the housing to hold the heat sink can be reduced so that the headlight can be downsized.

The cooling device of the present invention may also be applied to headlights of any of transportation carriers, e.g., automobiles, railway vehicle, ocean ships and vessels, aircraft and so on.

What is claimed is:

1. A cooling device for vehicle headlights, comprising:
an LED light source held in a housing sealed with a lens;
a reflector that reflects a light emitted from the LED light source;
a heat sink that is disposed behind the reflector;
a heat pipe that transports heat generated by the LED light source to the heat sink by a working fluid encapsulated therein;
a flat cuboid vapor chamber that serves as a heat collector on which the LED light source is mounted;
wherein the heat sink is comprised of a base covering the reflector from behind and above while keeping a distance therebetween, and a plurality of fins erected vertically to extend from the base in the opposite side of the reflector;
wherein a surface area of lower section of the fin is smaller than that of an upper section;
wherein the heat pipe includes
a first heat pipe in which one of end portions is flattened to be contacted with a front long side of the vapor chamber, and the other end portion penetrates through the upper section of the fin while being contacted therewith, and
a second heat pipe in which one of end portions is flattened to be contacted with a rear long side of the vapor chamber, and the other end portion penetrates through the upper section of the fin while being contacted therewith; and
wherein the reflector is isolated from the vapor chamber and the heat pipes.

2. The cooling device for vehicle headlights as claimed in claim 1, wherein the vapor chamber is comprised of:
a sealed container;
a working fluid held in the container; and
a wick that performs a capillary action.

3. The cooling device for vehicle headlights as claimed in claim 2, further comprising:
a piezo fan that cools the LED light source by sending air over the LED light source;
wherein the piezo fan is disposed at a site not to block an incident light to the reflector emitted from the LED light source.

4. The cooling device for vehicle headlights as claimed in claim 3,
wherein each of the first and the second heat pipe is further comprised of a branch contacted with an inner face of the housing; and
wherein said one of the end portion serves as an evaporating portion, said other end portion serves as a condensing portion, and the branch serves as another condensing portion.

5. The cooling device for vehicle headlights as claimed in claim 2,
wherein each of the first and the second heat pipe is further comprised of a branch contacted with an inner face of the housing; and
wherein said one of the end portion serves as an evaporating portion, said other end portion serves as a condensing portion, and the branch serves as another condensing portion.

6. The cooling device for vehicle headlights as claimed in claim 1, further comprising:
a piezo fan that cools the LED light source by sending air over the LED light source;
wherein the piezo fan is disposed at a site not to block an incident light to the reflector emitted from the LED light source.

7. The cooling device for vehicle headlights as claimed in claim 6,
wherein each of the first and the second heat pipe is further comprised of a branch contacted with an inner face of the housing; and
wherein said one of the end portion serves as an evaporating portion, said other end portion serves as a condensing portion, and the branch serves as another condensing portion.

8. The cooling device for vehicle headlights as claimed in claim 1,
wherein each of the first and the second heat pipe is further comprised of a branch contacted with an inner face of the housing; and
wherein said one of the end portion serves as an evaporating portion, said other end portion serves as a condensing portion, and the branch serves as another condensing portion.

* * * * *